US005679217A

United States Patent [19]

Outzen et al.

[11] Patent Number: 5,679,217

[45] Date of Patent: Oct. 21, 1997

[54] METHOD AND APPARATUS FOR OPTIMIZING THE LIQUOR-TO-WOOD RATIO DURING THE PRODUCTION OF PAPER PULP

[75] Inventors: Peter Outzen, Singapore, Singapore; Staffan Berg, Alno; Alf Aspvik, Sorberge, both of Sweden

[73] Assignee: Kvaerner Pulping AB, Karlstad, Sweden

[21] Appl. No.: 384,275

[22] Filed: Feb. 3, 1995

[51] Int. Cl.[6] ..... D21C 7/00; D21C 7/14

[52] U.S. Cl. ..... 162/19; 162/43; 162/237; 162/249

[58] Field of Search ..... 162/19, 37, 41–44, 162/47, 237–239, 241, 242, 248–251, 45

[56] References Cited

U.S. PATENT DOCUMENTS

| | | | |
|---|---|---|---|
| 2,996,422 | 8/1961 | Durant et al. | 162/37 |
| 3,578,554 | 5/1971 | Richter | 162/19 |
| 3,814,662 | 6/1974 | Starrett | 162/42 |
| 4,123,318 | 10/1978 | Sherman | 162/19 |
| 5,080,755 | 1/1992 | Backlund | 162/19 |
| 5,529,661 | 6/1996 | Backlund | 162/42 |
| 5,536,366 | 7/1996 | Marcoccia et al. | 162/43 |
| 5,547,012 | 8/1996 | Marcoccia et al. | 162/42 |

OTHER PUBLICATIONS

SE, B, 334809 (Kamyr AB), 3 May 1971 (3 May 1971), p. 4, line 7–line 10, figure 1.

*Primary Examiner*—Joseph W. Drodge
*Attorney, Agent, or Firm*—Farkas & Manelli, PLLC

[57] ABSTRACT

Provided is a method and apparatus which decreases a liquor—to—wood ratio at the top of a continuous digester while increasing a liquor—to—wood ratio in the upstream pre-impregnation vessel. A substantially wood-chip free liquor portion is drawn from the top of the digester through a heater to the bottom of the pre-impregnation vessel through a return conduit. A stream is drawn off the return conduit, upstream of the heater, for transfer to the top of the vessel without mixing with wool chips.

11 Claims, 1 Drawing Sheet

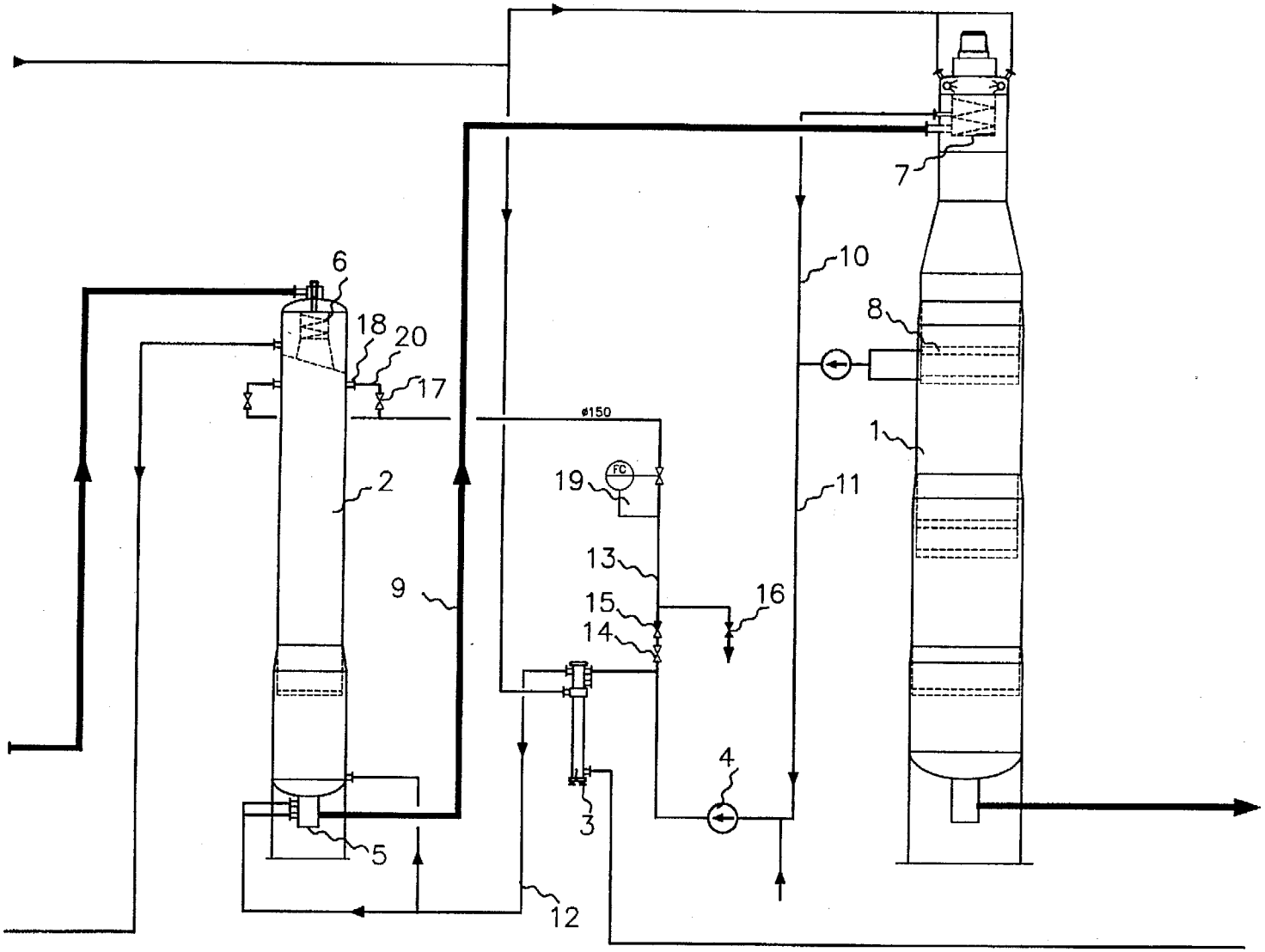
1
2
3
4
5
6
7
8
9
10
11
12
13
14
15
16
17
18
19
20
FC
ø150

METHOD AND APPARATUS FOR OPTIMIZING THE LIQUOR-TO-WOOD RATIO DURING THE PRODUCTION OF PAPER PULP

BACKGROUND OF THE INVENTION

The foreign priority document FE-94004330-0, filed on Feb. 10, 1994, is incorporated herein by reference.

1. Field of the Invention

The present invention relates to a method of achieving optimal liquor-to-wood ratios, especially in the pre-impregnation vessel and the top of the digester in association with the continuous production of paper pulp. The method also relates to an apparatus for achieving optimal liquor-to-wood ratios in a pre-impregnation vessel and a digester.

2. Description of Related Art

When producing chemical pulp in a continuous cooking process, liquid flows are often utilized for transporting the chips between different process vessels. In order to obtain maximum closure of the process, it is important that these liquid flows, once they have completed their task, are returned and used once again. This problem is most usually solved by means of so-called "circulations" at different points in the process. Thus, as an example, chips are transferred from the bottom of the pre-impregnation vessel to the top of the digester itself with the aid of a circulation which is usually called C5 or the transfer circulation. The function of C5 is as follows: once the chips have migrated down through the pre-impregnation vessel, and their treatment in this vessel has been completed, they are fed out at the bottom of the vessel using a feeding-out device. Recirculated liquor, which assists in conveying out the chips into the conduit, is also supplied to this feeding-out device. The pressure of the liquor is sufficiently large to convey the chips right to the top of the digester. Located at the top of the digester is a top separator, the function of which is to separate the chips from a part of the circulation liquor. An additional part of the liquor accompanies the chips some distance down into the upper part of the digester, and is then separated off with the aid of a screen section in the digester wall and combined with the liquor which was separated off in the top separator. The transfer circulation is closed by this combined liquor stream being returned to the feeding-out device in the bottom of the pre-impregnation vessel via a heat exchanger.

The circulation liquor which migrates down through the upper part of the digester together with the chips assists in bringing about an even and stable downwardly directed movement of the chip column. This is because the chip bed offers a resistance to the flow of liquor, resulting in the formation of a downwardly directed flow resistance force on the bed.

Another way of generating an extra force on the chip bed is to permit the level of chips to extend above that of the liquor in the top of the digester. In accordance with Archimedes' principle, the chips which are situated above the surface of the liquor exert a greater gravitational force on the underlying chips than do the chips which are immersed in the liquor. However, the combined forces also have another effect on the chip bed. The bed is not only pressed downwards, but is also pressed together, so that the space between the chip pieces decreases. This is expressed as the degree of packing increasing in the chip column. Too great a degree of packing has been found to be capable of causing difficulties and is therefore something which is preferably to be avoided. At the screen sections, the liquid flows radially outwards towards the wall of the digester, and a very compressed bed provides a flow resistance which results in a large force on the screen section. In association with this, friction arises against the screen wall which, in the worst case, leads to catching of the chip column. In such a case, the downwardly directed force is not adequate to overcome the friction against the screen wall, with the result that movement of the chip column ceases.

In order to avoid too great a degree of packing at the top of the digester, the level of liquor can be raised, and the liquor-to-wood ratio decreased, in the digester top. If this latter ratio is decreased, there will consequently be less liquid in relation to the quantity of wood. However, a decrease in the liquor-to-wood ratio often gives rise to problems with chips feeding out from the bottom of the pre-impregnation vessel, because a certain quantity of liquid is required for this procedure to function satisfactorily. This results in difficulties due to an increased tendency for plugs to occur in the top separator of the digester and in the transfer circulation.

Thus, there is no satisfactory method available at present for avoiding excessive degrees of packing at the top of the digester without adversely affecting the transfer of chips from the pre-impregnation vessel to the digester top.

SUMMARY OF THE INVENTION

An object of the invention is to avoid the problems associated with too great a degree of packing at the top of the digester and, at the same time, improve the operational efficiency of the pre-impregnation vessel.

The invention relates to a method which decreases the liquor-to-wood ratio at the top of the digester while at the same time increasing the liquor-to-wood ratio in the pre-impregnation vessel. The method comprises the steps of transferring liquor from the top of a digester to a pre-impregnation vessel.

The invention also relates to an apparatus which decreases a liquor-to-wood ratio at a top of a digester while at the same time increases a liquor-to-wood ratio in a pre-impregnation vessel of a pulp production plant. The apparatus comprises a conduit constructed and arranged between the top of the digester and the pre-impregnation vessel, whereby a portion of a liquor present in the top of the digester is transferred to the pre-impregnation vessel.

BRIEF DESCRIPTION OF THE FIGURE

The FIG. 1 illustrates a preferred embodiment of the invention including a conduit.

DETAILED DESCRIPTION OF PREFERRED EMBODIMENTS

The invention relates to a method which decreases the liquor-to-wood ratio at the top of the digester while at the same time increasing the liquor-to-wood ratio in the pre-impregnation vessel comprising the steps of transferring a portion of the liquor at the top of a digester to the pre-impregnation vessel.

Preferably, the liquor is transferred to the pre-impregnation vessel immediately below the top separator thereof.

The invention also relates to an apparatus which decreases a liquor-to-wood ratio at a top of a digester while at the same time increases a liquor-to-wood ratio in a pre-impregnation vessel of a pulp production plant. The apparatus comprises a conduit constructed and arranged between the top of the digester and the pre-impregnation vessel, whereby a portion of a liquor present in the top of the digester is transferred to the pre-impregnation vessel.

Preferably, the downstream end of the conduit is connected to the pre-impregnation vessel immediately below the top separator thereof.

Preferably, valves are installed at the proximity of the upstream end connection and at the proximity of the downstream end connection of the conduit to control the flow of liquor through the conduit. The valves can be, for example, hand valves. Optionally, a non-return valve is installed downstream of the valve at the upstream end connection to prevent the liquor from back-flowing.

Preferably, a drainage valve is installed on the conduit for removing liquor from the conduit. The drainage valve can be, for example, installed downstream of non-return valve, if present.

Preferably, a control loop comprising a flow meter and a control valve are installed on the conduit to monitor and control the flow of liquor through the conduit. The control loop can be, for example, installed downstream of a non-return valve, if present.

The downstream end of the conduit can be connected to the pre-impregnation vessel using connection pieces. For example, the platform connection pieces which are present on a pre-impregnation vessel can be used. In this case, preferably, pipe bends, which can readily be disassembled, are installed between the valves on the conduit in the vicinity of the pre-impregnation vessel and the platform connection pieces, so that the latter can be used for building a platform.

Using the method and apparatus described herein, the thrust on the chip column in the pre-impregnation vessel can be increased by increasing the liquor-to-wood ratio at that site, and at the same time, the liquor-to-wood ratio at the top of the digester can be lowered. The reason for this is that, by virtue of the new conduit, liquor can be conveyed from the transfer circulation.

In a preferred embodiment, the apparatus comprises a conduit having an upstream end connected to the pressure side of a pump C5, but prior to the heat exchanger, in the return conduit of the transfer circulation, and a downstream end of the conduit is connected to the top of the pre-impregnation vessel. At the top of the pre-impregnation vessel the liquor provides additional assistance to the downward movement of the chip column and contributes to efficient operation of the feeding-out device at the bottom thereof, despite the fact that lower quantities of liquor are being supplied to the feeding-out device by the "normal" route via the transfer circulation. The decreased flow of liquid to the digester also provides a lower liquor-to-wood ratio at the top of the digester and thereby decreases the risk of high degrees of packing occurring at that point.

Another positive result, is that there is equalization of the alkali concentration, and an increase in temperature, in the pre-impregnation vessel.

A further advantage is that the feed-in flow of black liquor can be decreased or completely shut off and the flow of flushing liquor to the pre-impregnation vessel can be decreased by at least the same quantity as the flow in the new circulation. Feed-out from the pre-impregnation vessel will in any case proceed in a more stable manner.

In addition to this, it is an advantage that the temperature in the transfer circuit can be raised somewhat, so that the flow of steam for heating the digester top can be decreased.

Another very positive result is that it will be possible to lower the kappa number of the pulp leaving the digester by the order of 1.5 units.

EXAMPLE 1

The invention will be further described in reference to following preferred, non-limiting, example shown in the drawing, which shows a part of the flow diagram for the cooking process of a pulp producing plant.

The apparatus and process comprises a digester 1 and a pre-impregnation vessel 2, as shown in the drawing. Both chips, down from the vessel, and the liquor, in the return conduit 12 from the transfer circulation, are supplied to the feeding-out device 5 at the bottom of the pre-impregnation vessel. The chips are conveyed, together with the liquor, out into an input conduit 9 to the top separator 7 of the digester, where a part of the liquor is separated off and passed to conduit 10. The remainder of the circulation liquor is conveyed some further distance down through the upper part of the digester, together with the chips, and is then separated off through a screen section 8, in order to be combined, in conduit 11, with the liquor in conduit 10. The liquor is then pumped through the C5 pump 4 to a heat exchanger 3 and then back to the feeding-out device 5 of the pre-impregnation vessel.

A conduit 13, of size DN150, for example, is connected to the return conduit of the transfer circulation on the pressure side of the C5 pump 4 but prior to the heat exchanger 3. Downstream of a branching point, the conduit is connected to a number of connection pieces 18 below the top separator 6 of the pre-impregnation vessel. A hand valve 14 and, downstream of this, a non-return valve 15 and a drainage valve 16, are expediently fitted to the said conduit 13 at its connection to the transfer circulation. Hand valves 17 are also expediently fitted at all the connections to the pre-impregnation vessel 2. A control loop 19, comprising a flow meter and a control valve, is installed on the novel conduit 13.

The platform connection pieces of the pre-impregnation vessel are used for connecting the conduit 13. The pipe bends 20, which can readily be disassembled, are located adjacent to the vessel in between the connection pieces 18 and the hand valves 17, so that the connection pieces can also be used for constructing a platform.

EXAMPLE 2

The invention will be further explained by the following non-limiting example. Tests were made at a mill for production of kraft softwood pulp. Through the installation of a conduit in which a constituent stream according to the invention could be conveyed to the top of the pre-impregnation vessel, the liquor-to-wood ratio in the top of the digester was lowered from 3.8:1 to 3.0:1. The feed-in flow of black liquor was completely shut off and the supply of steam to the top of the digester was lowered by 1.5–2 tons/hour, due to a higher temperature in the input conduit. At a flow rate of 100 $m^3/h$ in the new conduit, the flow of flushing liquor to the bottom of the pre-impregnation vessel was decreased by more than that amount. The operation of the feeding-out device became more stable. Indications also showed a Kappa number was approximately 1.5 units lower than usual without any decrease in viscosity of the pulp. No negative effects were registered.

While the invention has been described in detail and with reference to specific embodiments, including the drawing, it will be apparent to one of ordinary skill in the art that various changes and modifications can be made therein without departing from the spirit and scope thereof. For example, that the size of the conduit and the type of valves can be varied, and the exact location of the connections can be varied.

What is claimed is:

1. A method for optimizing a liquor-to-wood ratio at a top of a continuous digester while at the same time optimizing a liquor-to-wood ratio in a pre-impregnation vessel, the method comprising the steps of:

transferring wood chips and a circulation liquor from the bottom of the pre-impregnation vessel through an input conduit to the top of the continuous digester;

separating off a portion of the liquor present at the top of the continuous digester;

returning the portion of the liquor through a return conduit and heater to the bottom of the pre-impregnation vessel;

drawing off a stream of liquor from the return conduit upstream of the heater which is substantially free of wood chips; and transferring the stream of liquor which is substantially free-of wood chips to an upper portion of the pre-impregnation vessel without mixing the stream with wood chips prior to introduction to the vessel whereby a liquor-to-wood ratio in the continuous digester can be decreased while at the same time a liquor-to-wood ratio in the pre-impregnation vessel can be increased.

2. A method for optimizing a liquor-to-wood ratio at a top of a continuous digester while at the same time optimizing a liquor-to-wood ratio in a pre-impregnation vessel, the method comprising the steps of:

transferring wood chips and a circulation liquor from the bottom of the pre-impregnation vessel through an input conduit to the top of the continuous digester;

separating off a portion of the liquor present at the top of the continuous digester;

returning the portion of the liquor through a return conduit and heater to the bottom of the pre-impregnation vessel;

drawing off a stream of liquor from the return conduit upstream of the heater; and transferring the stream of liquor to the pre-impregnation vessel immediately below a top separator thereof.

3. A method according to claim 2, further comprising the step of transferring a sufficient amount of the stream of liquor to the pre-impregnation vessel to provide thrust on a chip column in the pre-impregnation vessel.

4. An apparatus which decreases a liquor-to-wood ratio in a digester while at the same time increases a liquor-to-wood ratio in a pre-impregnation vessel of a pulp production plant comprising:

a pre-impregnation vessel;

a continuous digester;

an input conduit for transferring wood chips and a circulation liquor from the bottom of the pre-impregnation vessel to the top of the continuous digester;

a return conduit for separating off a portion of the liquor present at the top of the continuous digester and returning the portion of the liquor to the bottom of the pre-impregnation vessel;

a heater for heating the portion of liquor in the return conduit; and a stream conduit connected to the return conduit upstream of the heater and connected to an upper portion of the pre-impregnation vessel for drawing off a stream of liquor which is substantially free of wood chips; and transferring the stream of liquor which is substantially free-of wood chips to said upper portion of the pre-impregnation vessel wherein the stream conduit is constructed and arranged to substantially exclude mixing wood chips with said liquor stream prior to introduction of said liquor stream to said vessel.

5. An apparatus which decreases a liquor-to-wood ratio in a digester while at the same time increases a liquor-to-wood ratio in a pre-impregnation vessel of a pulp production plant comprising:

a pre-impregnation vessel;

a continuous digester;

an input conduit for transferring wood chips and a circulation liquor from the bottom of the pre-impregnation vessel to the top of the continuous digester;

a return conduit for separating off a portion of the liquor present at the top of the continuous digester and returning the portion of the liquor to the bottom of the pre-impregnation vessel; and a heater for heating the portion of liquor in the return conduit;

the apparatus comprising:

a stream conduit connected to the return conduit upstream of the heater for drawing off a stream of liquor and transferring the stream of liquor to an upper portion of the pre-impregnation vessel, wherein the stream conduit is connected to the pre-impregnation vessel immediately below a top separator thereof.

6. The apparatus according to claim 5, wherein the apparatus further comprises a valve connected to the stream conduit for controlling a flow of liquor through the stream conduit.

7. The apparatus according to claim 5, wherein the apparatus further comprises a drainage valve connected to the stream conduit to remove liquor from the stream conduit and a valve between the drainage valve and the top of the digester for controlling a flow of liquor through the stream conduit.

8. The apparatus according to claim 5, wherein the stream conduit is connected to a plurality of connection pieces of the pre-impregnation vessel, associated valves are connected between each connection piece and the stream conduit for controlling the flow of liquor through the connection pieces.

9. The apparatus according to claim 5, further comprising a circulation pump for pumping the liquor through the return conduit, and wherein an upstream end of the stream conduit is connected to the return conduit between the heater and the circulation pump.

10. An apparatus which decreases a liquor-to-wood ratio in a digester while at the same time increases a liquor-to-wood ratio in a pre-impregnation vessel of a pulp production plant comprising:

a pre-impregnation vessel;

a continuous digester;

an input conduit for transferring wood chips and a circulation liquor from the bottom of the pre-impregnation vessel to the top of the continuous digester;

a return conduit for separating off a portion of the liquor present at the top of the continuous digester and returning the portion of the liquor to the bottom of the pre-impregnation vessel; and a heater for heating the portion of liquor in the return conduit;

said apparatus comprising:

a stream conduit connected to the return conduit upstream of the heater for drawing off a stream of liquor and transferring the stream of liquor to an upper portion of the pre-impregnation vessel; and a non-return valve connected to the stream conduit for preventing backflow of liquor in the stream conduit.

11. An apparatus which decreases a liquor-to-wood ratio in a digester while at the same time increases a liquor-to-wood ratio in a pre-impregnation vessel of a pulp production plant comprising:

a pre-impregnation vessel;

a continuous digester;

an input conduit for transferring wood chips and a circulation liquor from the bottom of the pre-impregnation vessel to the top of the continuous digester;

a return conduit for separating off a portion of the liquor present at the top of the continuous digester and returning the portion of the liquor to the bottom of the pre-impregnation vessel; and a heater for heating the portion of liquor in the return conduit;

said apparatus comprising:

a stream conduit connected to the return conduit upstream of the heater for drawing off a stream of liquor and transferring the stream of liquor to an upper portion of the pre-impregnation vessel; and a control loop comprising a flow meter and a control valve connected to the stream conduit for monitoring and controlling an amount of liquor flowing through the stream conduit.

* * * * *